US012623814B2

(12) United States Patent
Cote et al.

(10) Patent No.: US 12,623,814 B2
(45) Date of Patent: May 12, 2026

(54) LIQUID POURING APPARATUS

(71) Applicants: Lainey Blair Cote, Chicago, IL (US); Katherine Ann Miller O'Leary, Chicago, IL (US); Beatrice Eleanor Sanford, Chicago, IL (US)

(72) Inventors: Lainey Blair Cote, Chicago, IL (US); Katherine Ann Miller O'Leary, Chicago, IL (US); Beatrice Eleanor Sanford, Chicago, IL (US)

( * ) Notice: Subject to any disclaimer, the term of this patent is extended or adjusted under 35 U.S.C. 154(b) by 105 days.

(21) Appl. No.: 18/928,006

(22) Filed: Oct. 26, 2024

(65) Prior Publication Data

US 2026/0116625 A1 Apr. 30, 2026

(51) Int. Cl.

| | |
|---|---|
| ***B65D 25/46*** | (2006.01) |
| ***A47G 19/12*** | (2006.01) |
| ***B65D 25/28*** | (2006.01) |

(52) U.S. Cl.

CPC ..... *B65D 25/46* (2013.01); *A47G 19/12* (2013.01); *B65D 25/2844* (2013.01)

(58) Field of Classification Search

CPC .... B65D 25/46; B65D 25/2844; A47G 19/12; B05C 5/00; B05C 5/0225; B05C 5/0229; B05C 5/0233; B05C 11/11; B44D 3/12

See application file for complete search history.

(56) References Cited

U.S. PATENT DOCUMENTS 2,610,770 A * 9/1952 Penfield ..... B65D 5/76 222/364
2,786,612 A * 3/1957 Gallo ..... B65D 5/744 229/125.18
2,811,281 A * 10/1957 Donovan ..... B65D 5/76 206/229
3,057,524 A * 10/1962 Shanks ..... B65D 5/76 222/561
3,159,321 A * 12/1964 Severino ..... B65D 25/48 222/573
5,505,347 A * 4/1996 Roma ..... B65D 25/48 222/573
6,427,879 B1 * 8/2002 Caldwell ..... G01F 19/00 222/572

(Continued)

OTHER PUBLICATIONS

A_cup_for_unsteady_hands_Disability_Horizons.
Hand_Steady_Mug_The_Active_Hands_Company.
HandSteady_Rotatable_Handle_Cup_drinking_aid_for_people_with_hand_weakness.

*Primary Examiner* — Paul R Durand
*Assistant Examiner* — Randall A Gruby
(74) *Attorney, Agent, or Firm* — John J. Mariane

(57) ABSTRACT

A liquid pouring apparatus. The liquid pouring apparatus may include a container and a liquid transfer slide. The container may have four walls in the shape of a box of no less than four inches in width and no more than twelve inches in height of each wall and one end of the container may be enclosed by a bottom wall. The liquid transfer slide may have a slide base connected to one of the four walls at an edge opposite the bottom wall of the container. The point of connection between the liquid transfer slide and the container may be one or more hinges. The slide base may have two rails that extend from the edge of the slide base connected to the container to the opposite edge. An adjustable strap may be connected to one of the four walls of the container.

8 Claims, 9 Drawing Sheets

(56) References Cited

U.S. PATENT DOCUMENTS

| | | | | |
|---|---|---|---|---|
| 9,963,336 | B2 * | 5/2018 | Degraaf, III | B65D 25/48 |
| 10,661,946 | B2 * | 5/2020 | Cleland | B65D 25/20 |
| 2023/0294123 | A1 * | 9/2023 | Jolani | B44D 3/12<br>118/300 |
| 2024/0300261 | A1 * | 9/2024 | Jolani | B44D 3/12 |

* cited by examiner

LIQUID POURING APPARATUS

BACKGROUND

Countless individuals suffer from a wide range of conditions that cause involuntary shaking and/or other physical challenges with their hands, wrists, and arms that make daily tasks incredibly difficult. Exemplary conditions causing such challenges include Parkinson's disease, multiple sclerosis, and dystonia, each of which affects muscle control and coordination. Even basic tasks, like pouring a drink, can be extremely difficult for those so afflicted.

Despite advances in medical technology, there are currently no tools specifically designed to help individuals with involuntary tremors pour a liquid, such as a beverage, from its container to another vessel, such as a cup or glass, in a manner which minimizes the risk of spilling. The lack of adaptive solutions for this issue highlights a gap in assistive devices for people with tremor-related disorders. As such, there is a long-felt need for such a device that assists those suffering from involuntary tremors to assist them in pouring drinks.

SUMMARY

A liquid pouring apparatus is disclosed herein. The liquid pouring apparatus may include (1) a container and (2) a liquid transfer slide.

In some embodiments, the container of the liquid pouring apparatus may have a first wall and a second wall opposite the first wall, and a third wall and a fourth wall opposite the third wall, wherein the third wall may be connected to the first wall and the second wall and the fourth wall may be connected to the first wall and second wall. In some embodiments, the first wall, the second wall, the third wall, and the fourth wall may each comprise an inner side and an outer side, the first wall, the second wall, the third wall, and the fourth wall may each comprise a top edge and a bottom edge, and a bottom wall perpendicular to the first wall, the second wall, the third wall, and the fourth wall, wherein the bottom wall may be connected to the bottom edge of the first wall, the bottom edge of the second wall, the bottom edge of the third wall, and the bottom edge of the fourth wall. In some embodiments, an adjustable strap may be connected to the first wall.

In some embodiments, the liquid transfer slide of the liquid pouring apparatus may have a slide base, a first edge rail, and a second edge rail. The slide base may have a top side, a bottom side, a first edge, a second edge opposite the first edge, a third edge, and a fourth edge opposite the third edge, a width of the second edge may be less than a width of the first edge, and the first edge of the slide base may be movably connected to the top edge of the second wall. The first edge rail may be connected to the third edge of the slide base, wherein the first edge rail may be perpendicular to the slide base and may be connected to the top side of the slide base. The second edge rail may be connected to the to the fourth edge of the slide base, wherein the first edge rail may be perpendicular to the slide base may be connected to the top side of the slide base.

Additionally or alternatively, in some embodiments, the material of the container is wood and the material of the liquid transfer slide is either polycarbonate or acrylic.

Additionally or alternatively, in some embodiments, the width of the first edge of the slide base is equal to a width of the second wall of the container and a distance between the first edge of the slide base and the second edge of the slide base is less than a height of the second wall of the container.

Additionally or alternatively, in some embodiments, the slide base is cut into a trapezoidal prism with the width of the second edge of the slide base being at least half the width of the first edge of the slide base.

Additionally or alternatively, in some embodiments, the adjustable strap comprises an adjustable tri-glide buckle.

Additionally or alternatively, in some embodiments, widths of the first wall, the second wall, the third wall, and the fourth wall are no less than four inches and heights of the first wall, the second wall, the third wall, and the fourth wall are no more than twelve inches.

In some embodiments, the heights of the first wall, the second wall, the third wall, and the fourth wall are each the same height. Alternatively, in some embodiments, the heights of the first wall, the third wall, and the fourth wall are each the same height and a height of the second wall is greater than the heights of the first wall, the third wall, and the fourth wall.

Additionally or alternatively, in some embodiments, the first edge of the slide base is movably connected to the top edge of the second wall by one or more rotating hinges.

Advantages will become more apparent to those of ordinary skill in the art from the following description of the preferred embodiments, which have been shown and described by way of illustration. As will be realized, the present embodiments may be capable of other and different embodiments, and their details are capable of modification in various respects. Accordingly, the drawings and description are to be regarded as illustrative in nature and not as restrictive.

BRIEF DESCRIPTION OF THE DRAWINGS

The figures described below depict various embodiments of the devices and methods disclosed herein. It should be understood that the figures depict illustrative embodiments of the disclosed devices and methods and that the figures are intended to be exemplary in nature only. Further, wherever possible, the following detailed description refers to the reference numerals included in the following figures, in which features depicted in multiple figures are designated with consistent reference numerals.

There are shown in the drawings arrangements which are presently discussed, it being understood, however, that the present embodiments are not limited to the precise arrangements and instrumentalities shown, wherein.

The figures depict the present embodiments for purposes of illustration only. One skilled in the art will readily recognize from the following discussion that alternate embodiments of the structures and methods illustrated herein may be employed without departing from the principles of the invention described herein.

DETAILED DESCRIPTION

Introduction

Disclosed herein is a liquid pouring apparatus.

The liquid pouring apparatus is a device designed to assist those suffering from involuntary tremors in pouring beverages without spilling. As will be made clear below, the liquid pouring apparatus achieves this by housing the beverage carton in a container and pouring the liquid over a tapered transfer slide into a cup, glass or mug. In this way, the user is able to pour a beverage into a glass without spilling, even if the liquid pouring apparatus is shook while pouring.

Liquid Pouring Apparatus

Figure 1A:
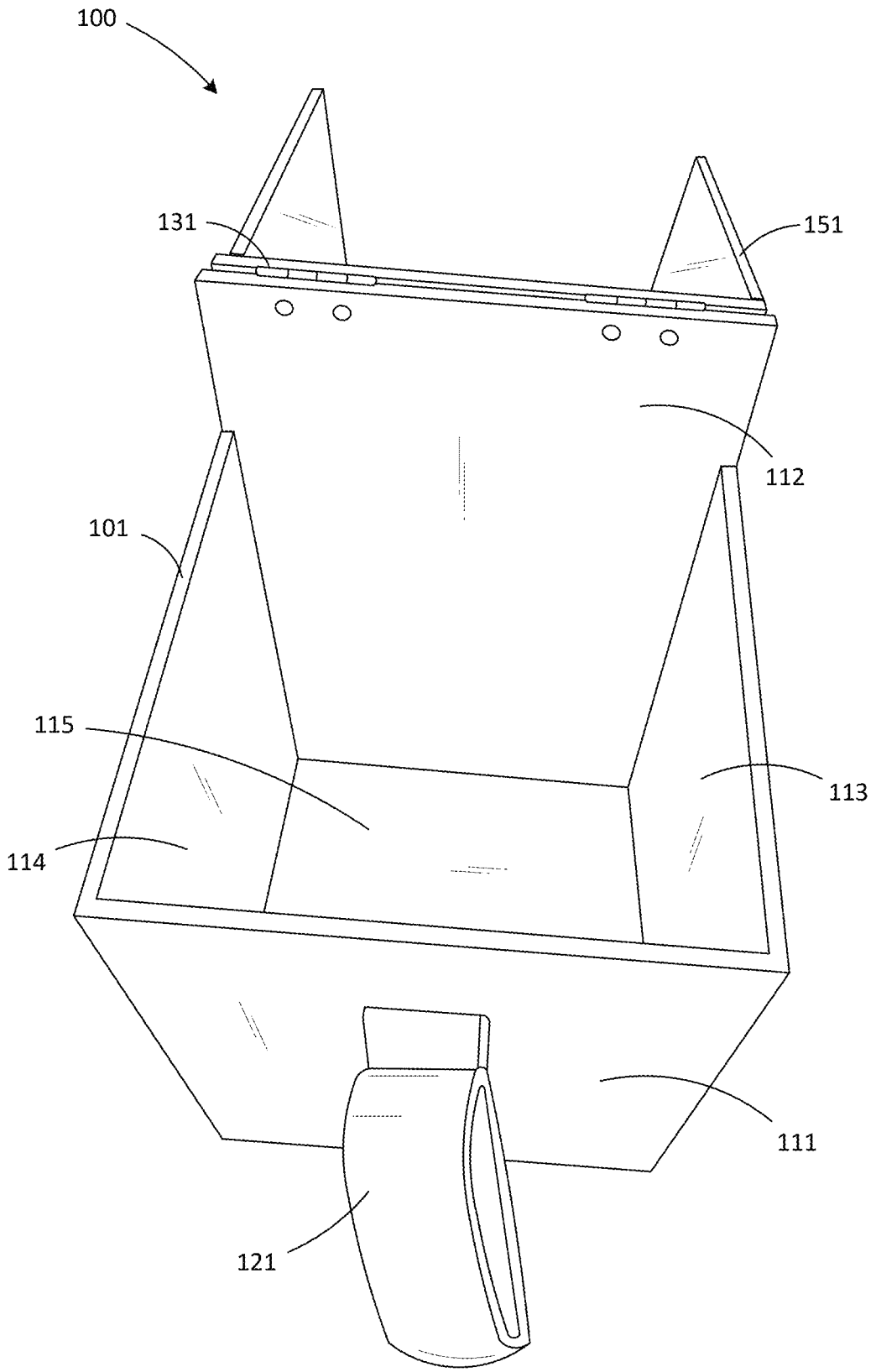
FIG. 1A depicts a first isometric view of an exemplary liquid pouring apparatus.
Figure 1B:
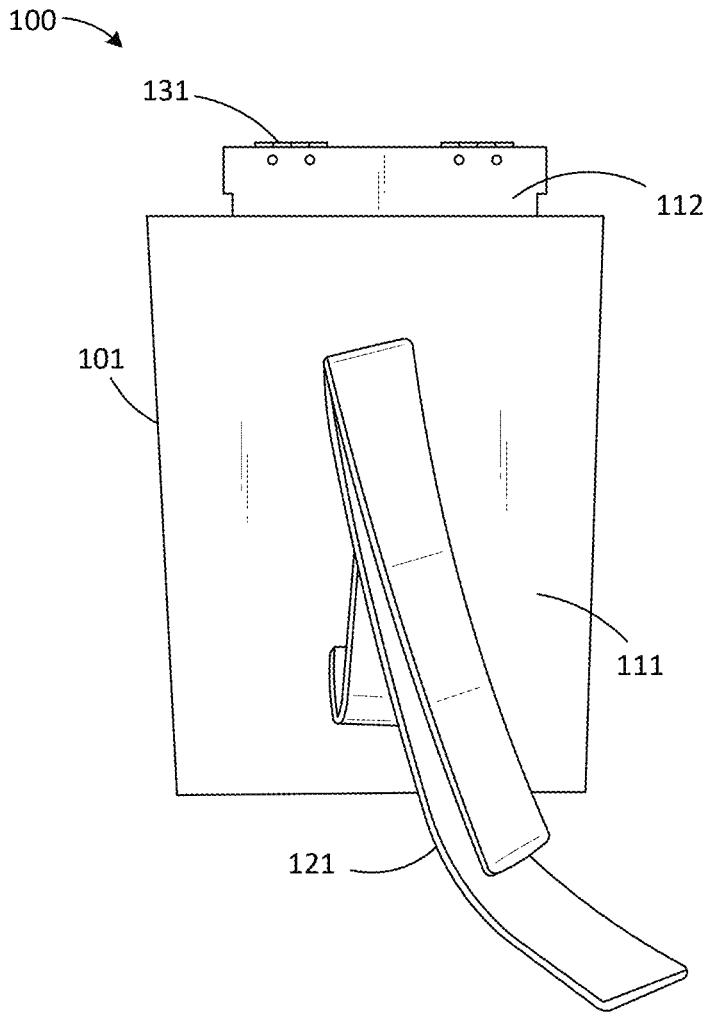
FIG. 1B depicts a second isometric view of an exemplary liquid pouring apparatus.
Figure 1C:
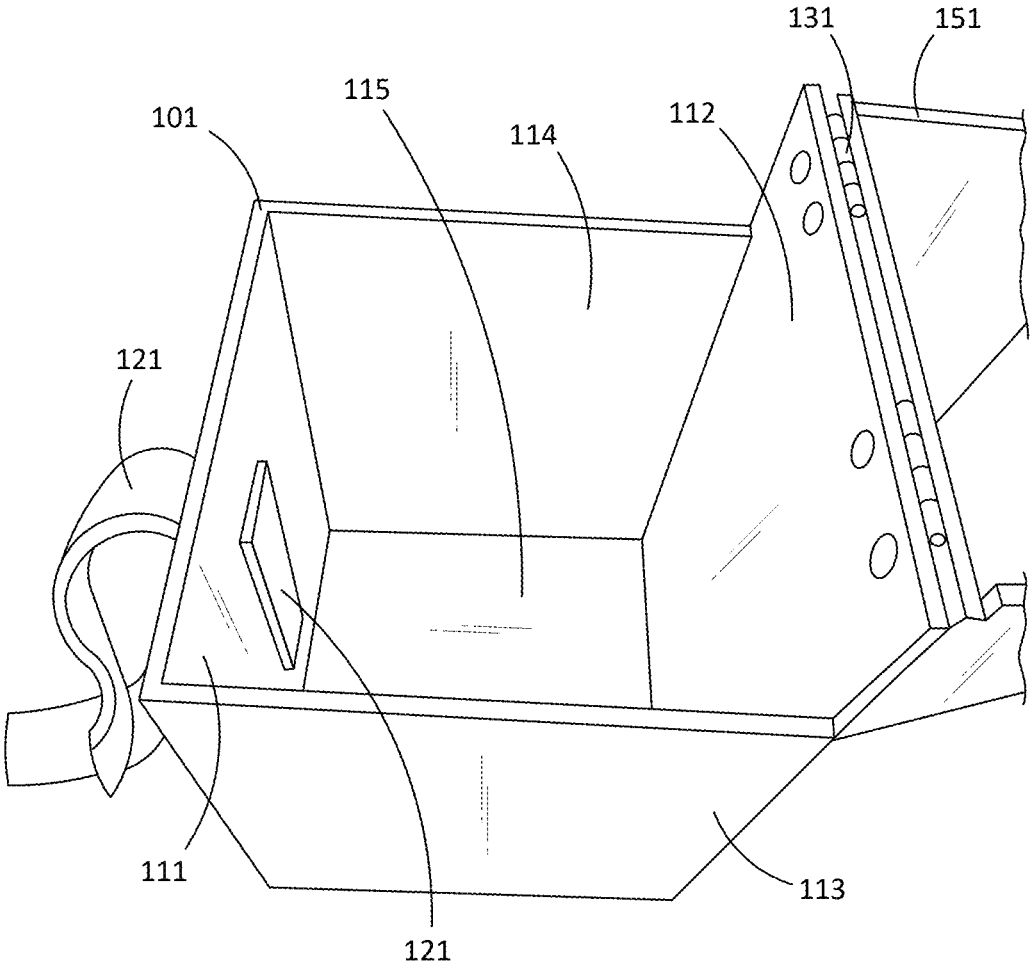
FIG. 1C depicts a third isometric view of an exemplary liquid pouring apparatus.
Figure 1D:
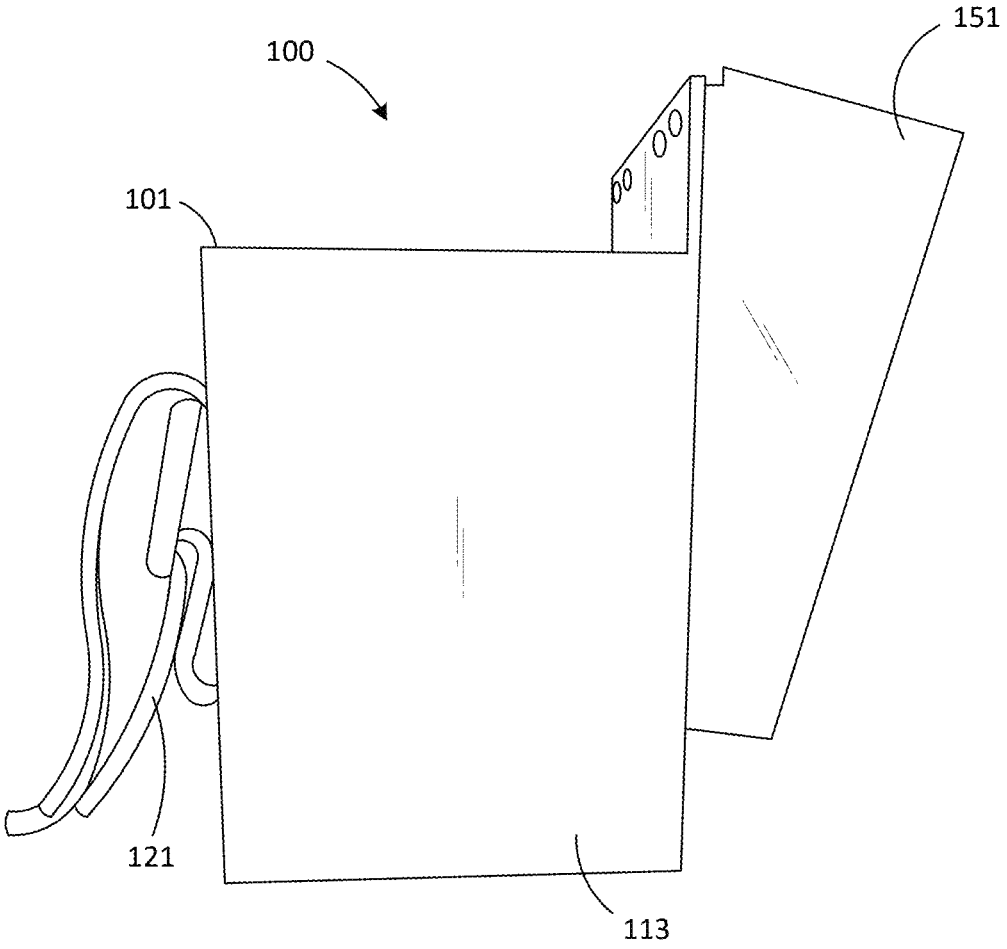
FIG. 1D depicts a fourth isometric view of an exemplary liquid pouring apparatus.
Figure 1E:
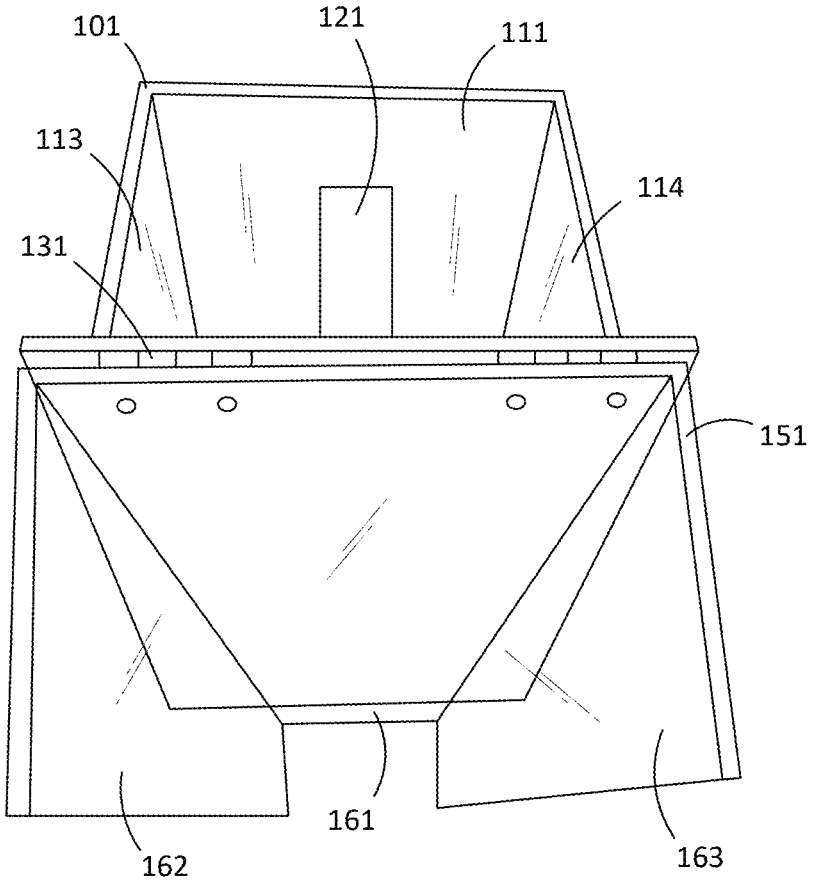
FIG. 1E depicts a fifth isometric view of an exemplary liquid pouring apparatus.
Figure 1F:
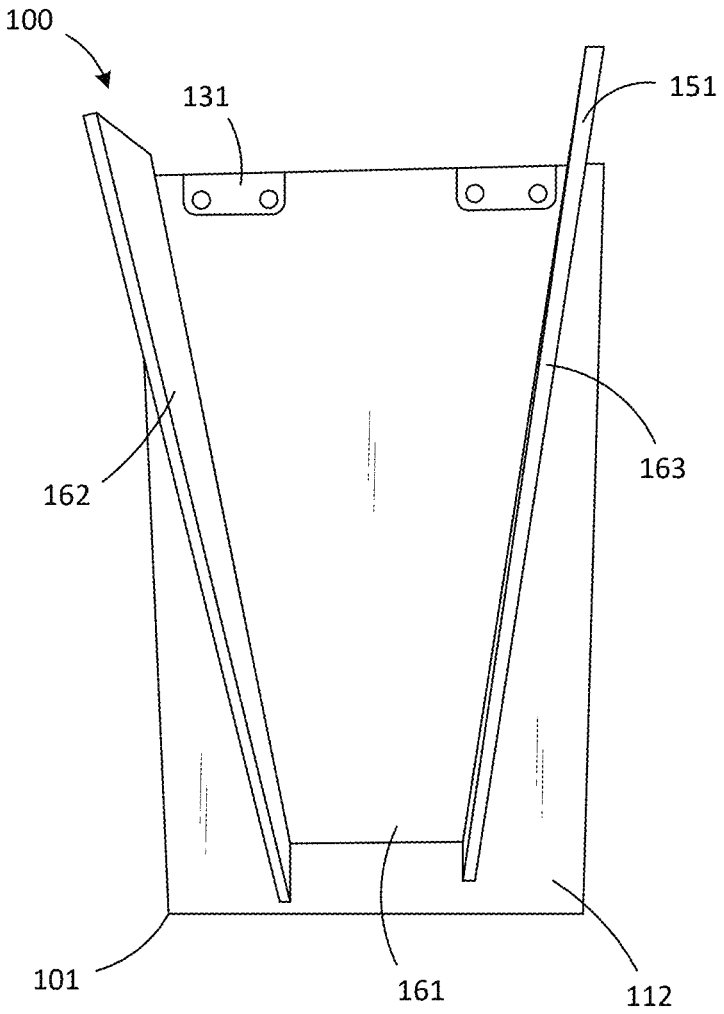
FIG. 1F depicts a sixth isometric view of an exemplary liquid pouring apparatus.
Figure 2A:
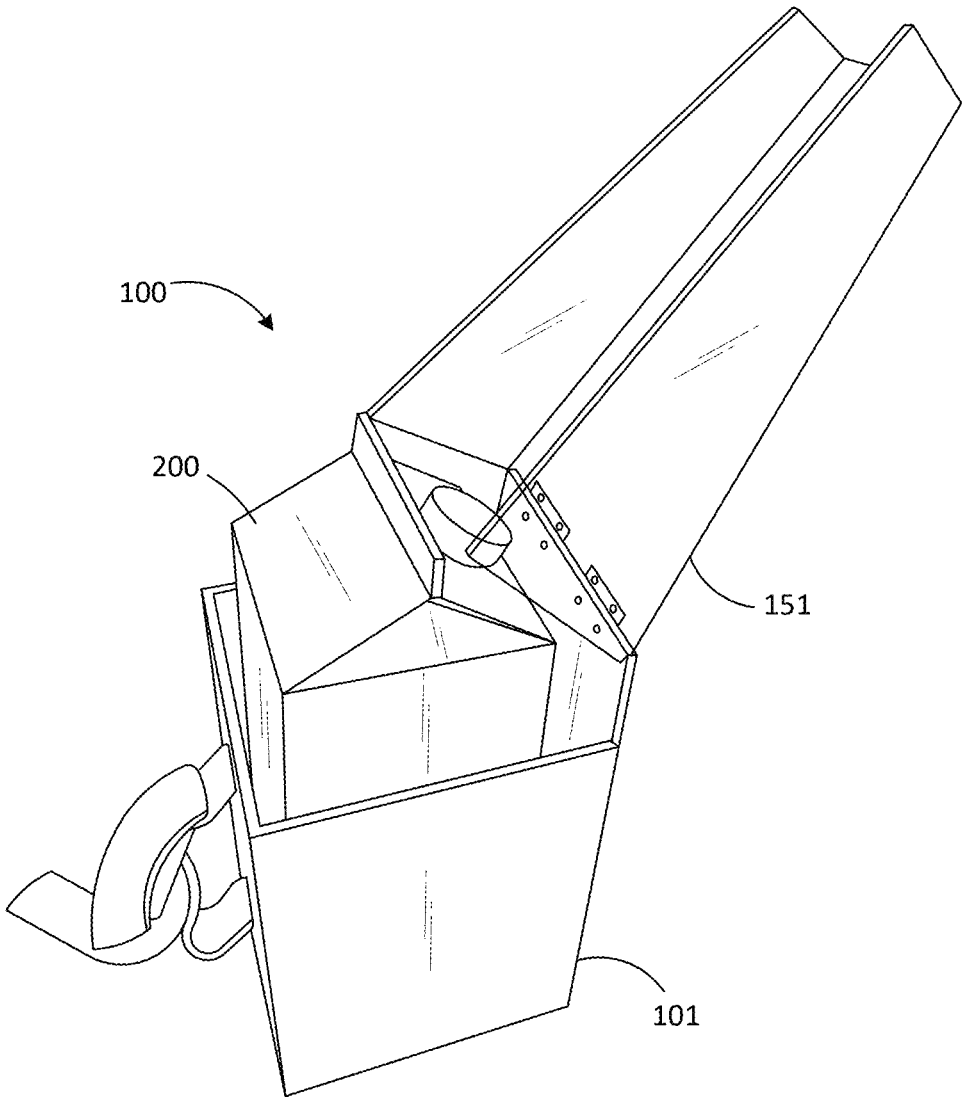
FIG. 2A depicts an isometric view of a first exemplary use of the liquid pouring apparatus.

As illustrated in FIGS. 1A-1F, a liquid pouring apparatus 100 may include a container 101 to hold a beverage carton 200 (as illustrated in FIG. 2A) and a liquid transfer slide 151. In some embodiments, the container 101 may include a first wall 111, a second wall 112, a third wall 113, a fourth wall 114, a bottom wall 115, and an adjustable strap 121. Also in some embodiments, the liquid transfer slide 151 may include a slide base 161, a first edge rail 162, and a second edge rail 163. In some embodiments, the liquid transfer slide 151 may be movably connected to the container 101, e.g., by one or more hinges 131.

As illustrated in FIGS. 1A-1F, the container 101 may be constructed into the shape of a box, where the first wall 111 is connected to the third wall 113 and the fourth wall 114, the second wall 112 is opposite the first wall 111 and also connected to the third wall 113 and the fourth wall 114 (wherein the third wall 113 is also opposite the fourth wall 114), and the bottom wall 115 is connected to the bottom side of the first wall 111, second wall 112, third wall 113, and the fourth wall 114. Each of the walls may be perpendicularly connected via any suitable attachment mechanism, such as interlocking joints, adhesives, nails, screws, bolts, etc. Each of the walls, except the bottom wall 115, may have the same width, as illustrated in FIGS. 1A-1F, but these walls need not be the same width. Similarly, each of the walls, except the bottom wall 115, may have the same height, but these walls need not be the same height, as illustrated in FIGS. 1A-1F (wherein the second wall 115 has a greater height than the first wall 111, the third wall 113, and the fourth wall 114). In some embodiments, the walls of the container 101 may be constructed from any suitably rigid material such as wood, metal, hardened plastic, and/or a composite material.

As illustrated in FIGS. 1A-1D, the adjustable strap 121 may be attached to the front wall 111 of the container 101. In some embodiments, the first wall 111 may have one or more holes to feed a portion the adjustable strap 121 through to affix it to the container 101. Additionally or alternatively, in some embodiments, the adjustable strap may be affixed or fastened to the inner side of the first wall 111 (e.g., via screws, nails, adhesive, etc.). Additionally or alternatively, in some embodiments, the adjustable strap 121 may be affixed or fastened to the outer side of the first wall 111 (e.g., via screws, nails, adhesives, etc.). In some embodiments, the adjustable strap 121 may have an adjustment component that adjusts the length of the strap, such as a buckle (e.g., a tri-glide buckle, an eight-shaped ring, a slide buckle, a pin buckle, a side release buckle, etc.).

As illustrated in FIGS. 1D-1F, the slide base 161 of the liquid transfer slide 151 may be constructed into the shape of a trapezoidal prism. In some embodiments, the wider parallel edge of the slide base 161 may have the same width as the second wall 112 of the container 101 and the narrower parallel edge of the slide base 161 may be at minimum one third of the width of the wider parallel edge. Additionally or alternatively, in some embodiments, the first edge rail 162 and the second edge rail 163 may be perpendicularly connected to the non-parallel edges of the slide base 161 (wherein the first edge rail 162 and the second edge rail 163 are also attached to the same side of the slide base 161). Additionally or alternatively, in some embodiments, the first edge rail 162 and the second edge rail 163 may be attached to the slide base via a suitable adhesive. The slide base 161 and the edge rails of the liquid transfer slide 151 may be constructed from any suitably rigid, non-porous, and washable material such as glass, metal, ceramic, hardened plastic, polycarbonate, and/or acrylic.

As illustrated in FIGS. 1E-1F, wider parallel edge of the slide base 161 may be movably connected to the second wall 112 of the container 101, e.g., by one or more hinges 131. In some embodiments, the one or more hinges 131 may be attached to the second wall 112 and the slide base 161 by any suitable attachment mechanism, such as nails, screws, bolts, etc. The one or more hinges 131 should be calibrated to allow for free rotation such that the liquid transfer slide 151 naturally hangs straight down when the liquid pouring apparatus 100 is rotated along the one or more hinges' 131 axis of rotation (so long as the container 101 is not rotated to make contact with the liquid transfer slide 151).

Figure 2B:
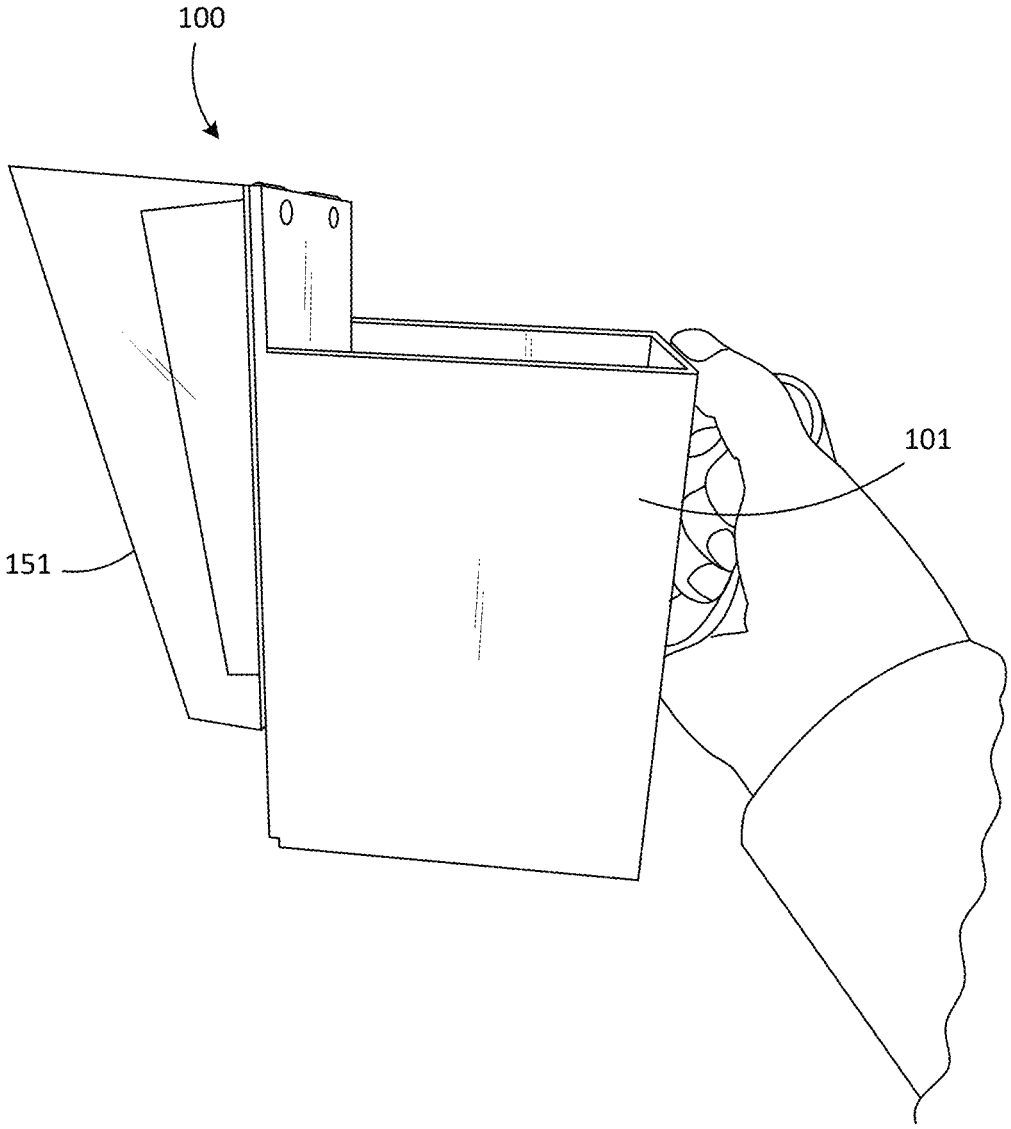
FIG. 2B depicts an isometric view of a second exemplary use of the liquid pouring apparatus.
Figure 2C:
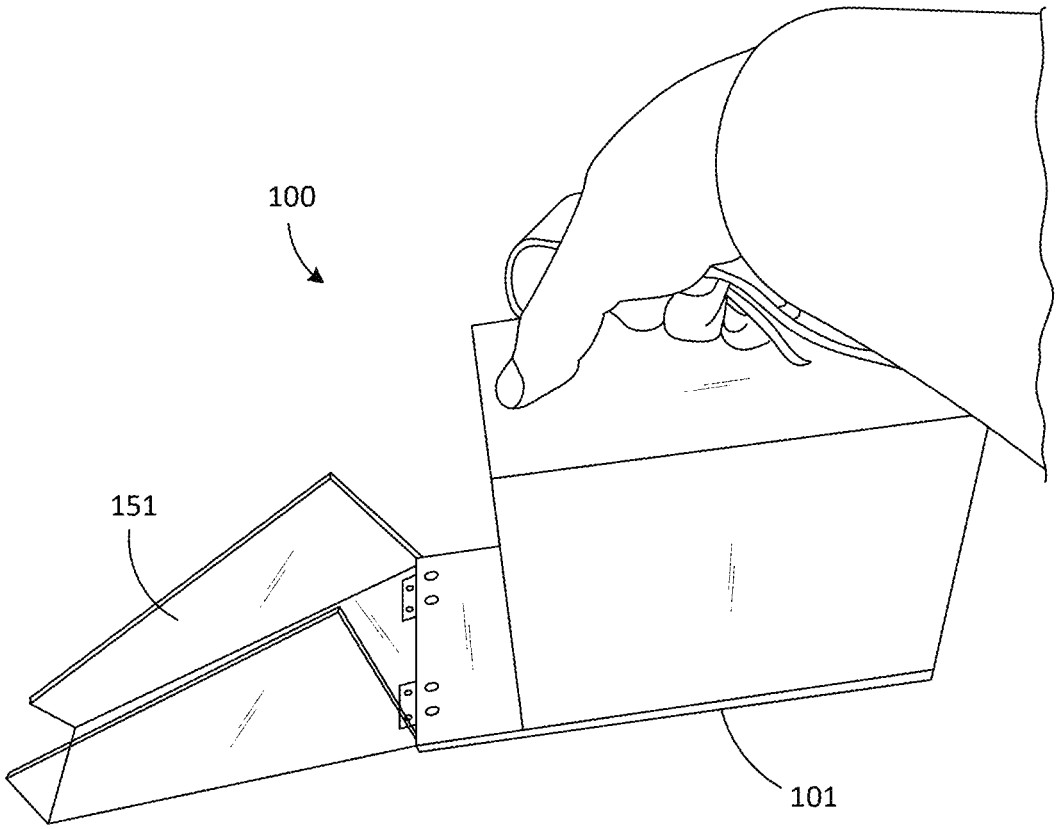
FIG. 2C depicts an isometric view of a third exemplary use of the liquid pouring apparatus.

As illustrated in FIGS. 2A-2C, a user may place a beverage carton 200 (e.g., a milk carton, a juice carton, a juice bottle, a soda bottle, etc.) into the container 100 and grip and/or wrap their hand with the adjustable strap 121. The user may then lift and tilt the container 100 such that the liquid transfer slide 151 may be placed into a beverage container of the user's choosing (e.g., a cup, a glass, a mug, etc.). The user may then tilt the container 100 further such that the liquid in the beverage carton 200 may then travel down the liquid transfer slide 151 and into the beverage container.

ADDITIONAL CONSIDERATIONS

Although the text herein sets forth a detailed description of numerous different embodiments, it should be understood that the legal scope of the invention is defined by the words of the claims set forth at the end of this disclosure. The detailed description is to be construed as exemplary only and does not describe every possible embodiment, as describing every possible embodiment would be impractical, if not impossible. One could implement numerous alternate embodiments, using either current technology or technology developed after the filing date of this disclosure, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "some embodiments" means that a particular element, feature, structure, or characteristic described in connection with the embodiment may be included in at least one embodiment. The appearances of the phrase "some embodiments" in various places in the specification are not necessarily all referring to the same embodiment. In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

While particular embodiments and applications have been illustrated and described, it is to be understood that the disclosed embodiments are not limited to the precise construction and components disclosed herein. Various modifications, changes, and variations, which will be apparent to those skilled in the art, may be made in the arrangement, operation and details of the method and apparatus disclosed herein without departing from the spirit and scope defined in the appended claims.

The particular features, structures, or characteristics of any specific embodiment may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein. It is therefore intended that the foregoing detailed description be regarded as illustrative rather than limiting, and that it be understood that it is the following claims, including all equivalents, that are intended to define the spirit and scope of this invention.

What is claimed is:

1. A liquid pouring apparatus comprising:

a container comprising:

a first wall and a second wall opposite the first wall, a third wall and a fourth wall opposite the third wall, wherein the third wall is connected to the first wall and the second wall, wherein the fourth wall is connected to the first wall and second wall, the first wall, the second wall, the third wall, and the fourth wall each comprising an inner side and an outer side, the first wall, the second wall, the third wall, and the fourth wall each comprising a top edge and a bottom edge, a bottom wall perpendicular to the first wall, the second wall, the third wall, and the fourth wall, wherein the bottom wall is connected to a bottom edge of the first wall, a bottom edge of the second wall, a bottom edge of the third wall, and a bottom edge of the fourth wall, and an adjustable strap connected to the first wall; and a liquid transfer slide comprising:

a slide base, wherein:

the slide base has a top side, a bottom side, a first edge, a second edge opposite the first edge, a third edge, and a fourth edge opposite the third edge, a width of the second edge being less than a width of the first edge, and the first edge of the slide base is movably connected to the top edge of the second wall, a first edge rail connected to the third edge of the slide base, wherein:

the first edge rail is perpendicular to the slide base and is connected to the top side of the slide base, and a second edge rail connected to the fourth edge of the slide base, wherein: the first edge rail is perpendicular to the slide base and is connected to the top side of the slide base, wherein heights of the first wall, the second wall, the third wall, and the fourth wall are no more than twelve inches, wherein the heights of the first wall, the third wall, and the fourth wall are each the same height and a height of the second wall is greater than the heights of the first wall, the third wall, and the fourth wall.

2. The liquid pouring apparatus of claim 1, wherein a composition of the first wall, the second wall, the third wall, the fourth wall, and the bottom wall is wood.

3. The liquid pouring apparatus of claim 1, wherein a composition of the liquid transfer slide is either polycarbonate or acrylic.

4. The liquid pouring apparatus of claim 3, wherein the width of the first edge of the slide base is equal to a width of the second wall of the container and a distance between the first edge of the slide base and the second edge of the slide base is less than a height of the second wall of the container.

5. The liquid pouring apparatus of claim 4, wherein the slide base is cut into a trapezoidal prism with the width of the second edge of the slide base being at least half the width of the first edge of the slide base.

6. The liquid pouring apparatus of claim 1, wherein the adjustable strap comprises an adjustable tri-glide buckle.

7. The liquid pouring apparatus of claim 1, wherein widths of the first wall, the second wall, the third wall, and the fourth wall are no less than four inches.

8. The liquid pouring apparatus of claim 1, wherein the first edge of the slide base is movably connected to the top edge of the second wall by one or more rotating hinges.

* * * * *